United States Patent [19]

Molz

[11] Patent Number: 4,712,406

[45] Date of Patent: Dec. 15, 1987

[54] APPARATUS FOR BENDING TUBULAR WORKPIECES

[75] Inventor: Theodor Molz, Chur, Switzerland

[73] Assignee: W. Eckold AG, Switzerland

[21] Appl. No.: 865,899

[22] Filed: May 21, 1986

Related U.S. Application Data

[63] Continuation-in-part of Ser. No. 836,205, Feb. 27, 1986, abandoned, which is a continuation of Ser. No. 585,132, Mar. 1, 1984, abandoned.

[30] Foreign Application Priority Data

Mar. 2, 1983 [DE] Fed. Rep. of Germany ..... 330728

[51] Int. Cl.[4] ..... B21D 7/024

[52] U.S. Cl. ..... 72/23; 72/30; 72/297; 72/321; 72/323; 72/306; 72/403; 72/413

[58] Field of Search ..... 72/22, 23, 30, 403, 72/400, 399, 322, 323, 304, 308, 318, 309, 481, 482, 478, 413, 369, 370, 306, 381, 384, 387, 388, 297, 296

[56] References Cited

U.S. PATENT DOCUMENTS

| | | | |
|---|---|---|---|
| 1,349,219 | 8/1920 | Moore et al. | 72/387 |
| 2,018,040 | 10/1935 | Sweeney | 72/309 |
| 2,044,322 | 6/1936 | Oliver et al. | 72/369 |
| 2,190,423 | 2/1940 | Henricson | 72/323 |
| 2,305,850 | 12/1942 | Drysdale | 72/322 |
| 2,399,348 | 4/1946 | Hobbs | 72/399 |
| 2,533,470 | 12/1950 | Kapelis | 72/473 |
| 2,557,346 | 6/1951 | Green | 72/306 |
| 2,850,071 | 9/1958 | Kraybill | 72/297 |
| 3,181,331 | 5/1965 | Wishing | 72/702 |
| 4,212,188 | 7/1980 | Pinson | 72/413 |

FOREIGN PATENT DOCUMENTS

| | | | |
|---|---|---|---|
| 1128681 | 1/1957 | France | 72/413 |
| 1585733 | 3/1981 | United Kingdom | 72/321 |
| 766706 | 9/1980 | U.S.S.R. | 72/413 |

*Primary Examiner*—Daniel C. Crane

*Attorney, Agent, or Firm*—McCormick, Paulding & Huber

[57] ABSTRACT

A method and apparatus for bending tubular workpieces whereby a tube length is placed in front of a template and selectively driven deforming shoes urge the tube into engagement with the same. Where the desired tubular radii of curvature are relatively large the deforming shoes are driven from a stationary mount. Where shorter tubular radii are desired, generally near the tube ends, the deforming shoes are arranged such that they are incrementally translated along a path commensurable with the contour of the template. At each successive increment the deforming shoes perform a bending operation upon the tube such that it may be successively formed into its desired shape.

8 Claims, 6 Drawing Figures

APPARATUS FOR BENDING TUBULAR WORKPIECES

CROSS REFERENCE TO RELATED PATENT APPLICATIONS

The present application is a Continuation-In-Part of Application Ser. No. 06/836,205, filed on Feb. 27, 1986, now abandoned, which is a continuation of Ser. No. 06/585,132, filed on Mar. 1, 1984. now abandoned.

FIELD OF THE INVENTION

The present invention relates to a method and apparatus for bending tubular workpieces, and more particularly, tubes having a rectangular, C-shaped, or U-shaped cross-section where the individual piece to be deformed may be of substantial length.

BACKGROUND OF THE INVENTION

It is often desireable to bend tube lengths such that they assume a non-circular configuration with a high degree of accuracy. For example, self-supporting frames for railroad cars, autobuses, and other vehicles often comprise vertical posts whose upper ends are to be welded to roof carrying struts having a mirror-symmetrical configuration with parabolically bent end portions.

Prior art methods and devices have attempted to attain such tube configurations by moving the tube length to be deformed against a template and employing a hammering mechanism which imparts numerous strokes against the tube such that the latter is progressively cold forged into the desired shape. The operation of this apparatus requires a great degree of skill and experience. Furthermore, it is rather dangerous since tube lengths of ten feet or more must be freely moved between hammering operations. Finally, the hammering mechanism necessarily produces undesireable noise.

SUMMARY OF THE INVENTION

According to the invention, a horizontal base plate carries an adjustable template having a contour commensurable with the desired tube shape and the elastic properties of the same. A tube length is placed in front of the template, and starting approximately at the center of the tube length, hydraulically operated deforming shoes urge the tube into engagement with the template. Where the radii of curvature are large, the hydraulically operated shoes are ball-joint coupled to stationary hydraulic cylinders. Where shorter radii are required, usually near the tube end, as is the case for the roof carrying struts mentioned above, a hydraulic cylinder with its shoe is incrementally translated along a path commensurable with the contour of the cooperating template and operated so as to forcibly engage the tube against the template at each successive increment. Hold-down plates may be provided to avoid upward buckling of the tube. Preferably, each bending step results in only a limited stroke of the free tube end so as to reduce the risk of accidents.

It is an object of the present invention to provide a method for bending tubular material which is easily implemented even by unskilled personnel.

It is another object of the present invention to provide a method which is less dangerous and noisy than previously known methods.

It is a further object of the present invention to provide an apparatus for bending a tube length into a desired shape wherein adjustable template means permit accurate operation by unskilled personnel and also permit compensation for dimensional variations between batches of tubular material.

DESCRIPTION OF PREFERRED EMBODIMENTS

Figure 1:
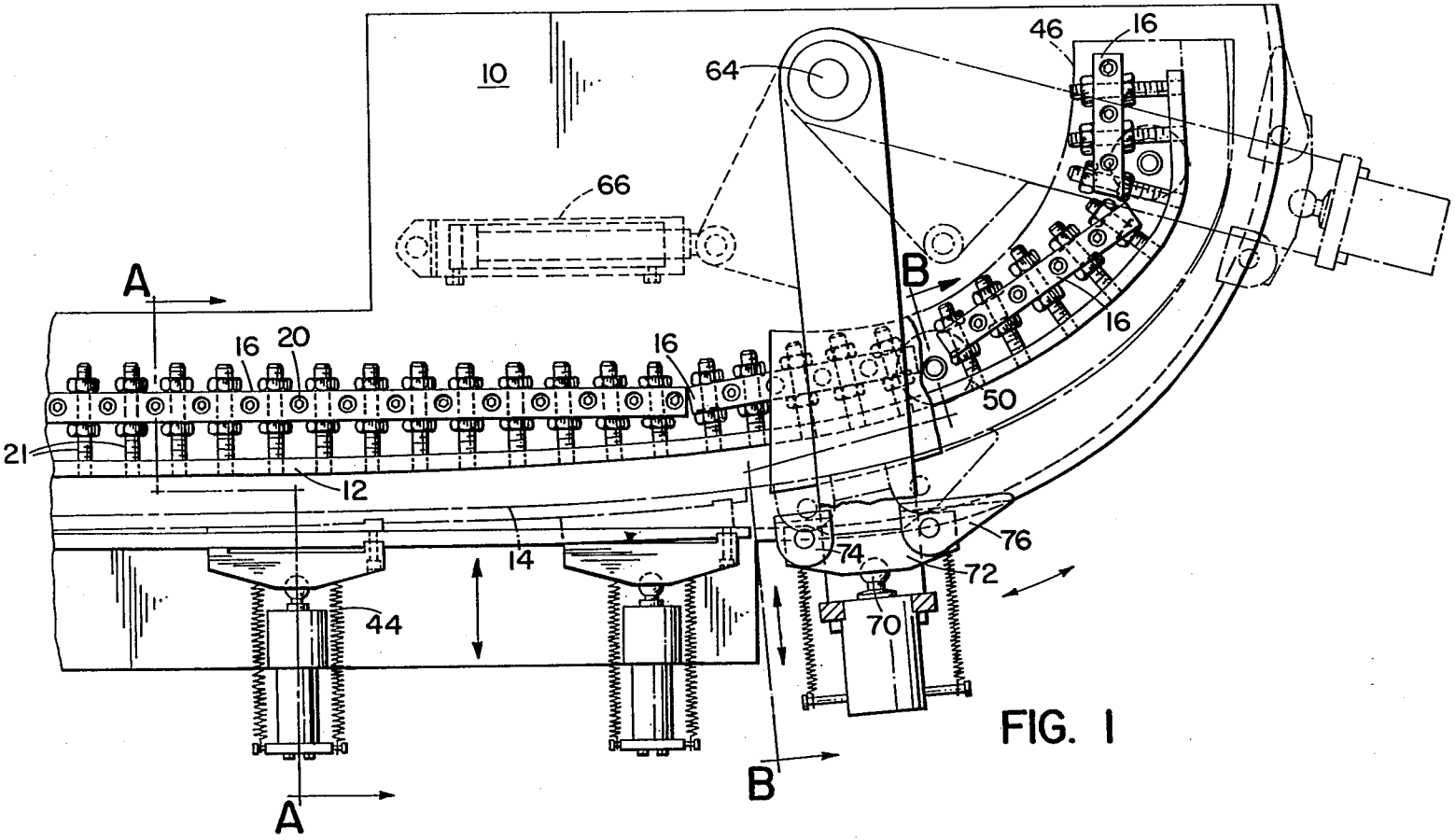
FIG. 1 is a top plan view of a part of an installation according to the invention, illustrated partly in section.

As mentioned above the installation is a mirror-symmetrical configuration, and therefore it is sufficient to illustrate and describe just one-half of the apparatus, as shown on FIG. 1.

A base plate 10 is mounted horizontally on a base frame or support (not shown) at a level permitting easy disposition of tubes to be bent thereon. Supplementary appliances, including hydraulic pressurizing pumps, are mounted beneath the base plate 10. On top of the base plate, a shape member or template 12 is mounted against which the tubular workpiece is formed by means of forces applied substantially orthogonally with respect to the tube axis.

The shape member 12 comprises both appropriate dimensions and elastic properties such that it may be deformed within relatively broad limits. However, shape member 12 will, in operation, be subjected to very high loads, and for this reason it is supported at relatively narrow intervals at its side opposite the tube 14. For this purpose, a plurality of socket members shown typically at 16 are seated within one or more grooves, shown typically at 18 machined in the upper face of base plate 10 and following a path substantially conforming to the curvature of the desired workpiece, as shown typically in FIG. 1 and FIG. 2. Each socket member is rigidly fastened to base plate 10 by means of a series of bolts, shown typically at 20. A series of threaded bolts, shown typcially at 21, extend parallel to base plate 10 through respective passage holes, shown typically at 22 on FIG. 2, in socket members 16. A series of threaded holes, shown typically at 24, are arranged within shape member 12 so as to receive bolts 21. A pair of adjustment nuts, shown typically at 26, are threadedly engaged with each respective bolt 21 at either side of each socket member 16. As long as each of the nuts 26 are positively threaded against their associated socket member 16, shape member 12 is rigidly connected with the same along that portion of its length and therefore rigidly mounted to base plate 10. The curvature of shape member 12 may be adjusted through cooperative rotation of each of the nuts 26 about their respective socket member 16. It is preferable that shape member 12 be manufactured such that it has a pre-existing curvature substantially conforming to that of the desired workpiece so that it may be elastically deflected in either direction within desired limits.

At the side of tube 14 opposite that facing shape member 12, bending forces are applied by means of tool members such that the tube is deformed plastically, i.e., beyond its limit of elasticity, against shape member 12. During this operation, tube 14 is preferably internally supported by core means (not shown), to eliminate the risk of buckling or collapsing of the same. At the left-hand side FIG. 1 (that is, in fact, the central area of tube 14 because of FIG. 1 illustrates only one-half of the apparatus), large radii of curvature are to be produced. For this purpose, hydraulic piston support members, shown typically at 32, comprising respective pivot pins, shown typically at 30, are rotatably mounted within bearing holes, shown typically at 28, arranged within base plate 10. Each support member 32 carries a hydraulic cylinder 34. A piston rod, shown typically at 36, places each respective cylinder in driving relation, via a ball joint 38, to a pressure shoe 40. Each pressure shoe is threadedly connected adjacent one of its lateral ends to a pressure strip 42 made of an elastically deformable material. Through actuation of each hydraulic cylinder the cooperating pressure shoe and contiguous portion of the pressure strip forcibly engage the adjacent portion of tube 14 against shape member 12. Return of pressure shoes 40 into their initial, non-operative position is effected by helical tension springs, shown typically at 44 on FIG. 1. Support strip 42 is arranged so as to bridge the intervals between adjacent pressure shoes and thereby function to substantially eliminate the risk of tube 14 yielding away from shape member 12. Support strip 42 is preferably made of a length of spring steel tape.

Figure 3:
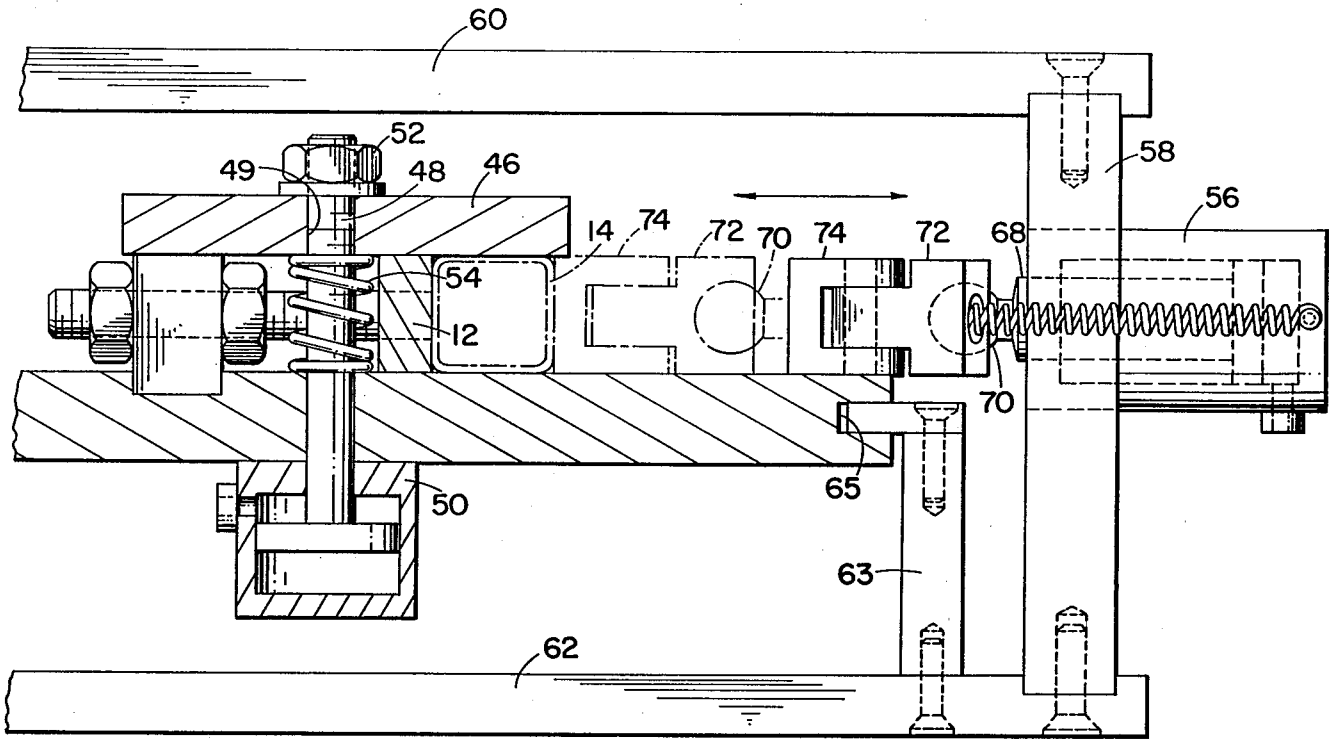
FIG. 3 is a partial sectional view in the plane defined in FIG. 1 by line B—B, likewise with enlarged scale.

At either end, the tube 14 must assume a configuration comprising shorter radii than at its central portions (again, at the other end of tube 14 not shown, a similar deformation is to be produced in a mirror-symmetrical manner). Thus, the tubular workpiece will be subjected to even higher forces, and it will be necessary to not only support the tube internally by the core mentioned above, but also to provide means to constrain tube 14 from vertical movement with respect to base plate 10. For this purpose, the apparatus comprises a pair of hold-down plates, shown typically at 46 on FIGS. 1 and 3. A pair of vertical hydraulic cylinders shown typically at 50, are mounted beneath each base plate 10. Each cylinder is drivingly connected to a piston rod, shown typically at 48 which extends through a clearance hole, shown typically at 49, arranged within hold-down plate 46. A nut, shown typically at 52, is threadedly engaged with the upper end of piston rod 48, such that its lower surface is arranged in pressurized contact with plate 46. With hydraulic fluid pressure fed to cylinders 50, plate 46 is pulled downwardly and arranged in pressurized engagement with shape member 12 and socket members 16, as shown in FIG. 3. Plate 46 extends beyond shape member 12 in an overlying relation with tube 14. Upon the release of fluid pressure within hydraulic cylinder 50 each hold-down plate 46 is lifted by a pair of helical pressure springs, shown typically at 54. Shim plates may be used to adapt the downward stroke of plate 46 to the vertical dimension of tube 14, such shim plates not being illustrated in the drawings.

A pair of hydraulic cylinders, shown typically at 56, are each mounted within respective vertical support plates, shown typically at 58. Support plate 58 is bolted with its upper and lower edges to lever arms 60 and 62 respectively, as shown typically in FIG. 3, of a lever system which is pivotable about a pivot 64, shown typically on FIG. 1, provided in base plate 10. From the outer end of arm 62, a guide member 63 extends vertically upwardly and engages with its horizontal extension into a groove 65 of base plate 10, functioning to relieve some of the vertical load carried by pivot bearing 64.

Fig. 1 shows in solid lines the inoperative position of arms 60, 62 and hydraulic cylinder 56. From this initial position, the lever system is pivotable through a 90° sweep by means of a hydraulic cylinder, shown typically at 66. The end sweep positions of arms 60 and 62 are indicated in dashed lines. At the other end of the apparatus, of course, a mirror-symmetrical system is provided for the other end of tube 14.

Each cylinder 56 comprises a piston, shown typically at 68, which is placed in driving relation via ball joint 70 to a block 72, to which two pressure shoes, shown typically at 74 and 76, are pivotably coupled. While plate 58 follows a circular path upon actuation of cylinder 66 the desired contour of tube 14 will be parabolic and therefore the working stroke of cylinder 56 must accordingly compensate for the differences in curvature to effect a continuous abuttment of tube 14 against shape member 12.

In use, at first a tube 14 is placed on base plate 10 as shown in FIG. 1. Thereafter, the cylinder adjacent the symmetry plane of the apparatus, shown typically at 34, is actuated, functioning to safely clamp tube 14 against shape member 12. The successive cylinders in the outward direction are then incrementally actuated with pressurized fluid to effect a curvature in the tube part where large radii are desired. Subsequently, the support core, as set forth above, is inserted into tube 14 from either or both ends. The vertical cylinders 50 are then actuated to drive hold-down plate 46 into pressurized contact with shape member 12 and socket members 16, to constrain vertical motion of tube 14. Cylinders 56 are subsequently actuated, in an alternating manner with the cooperating cylinders 66. In this manner, tube 14 is incrementally deformed to assume the desired configuration. It is recognized that the angular stroke of the lever system, comprising arms 60 and 62, will be necessarily shorter with corresponding decreases in the desired radii of curvature of tube 14. The angular stroke, of course, is determined by the stroke of cylinder 66 which is accordingly controlled.

After the last stroke of cylinders 56, when the lever system comprising arms 60 and 62 is at its most outward positon, fluid pressure is removed from all cylinders so that the return springs 44 may withdraw shoes 74, 76 and support strip 42 into their initial inoperative positions. Hold-down plates 46 are also lifted under the action of springs 54, and the bent tube 14 may then be removed from the apparatus.

The first pieces of a batch may be controlled by comparing them with a pattern piece or by means of an appropriate template (not shown). If necessary, shape member 12 may be readjusted, so as to account for variable parameters within the tube batch, such as for example, wall thickness and material stiffness.

The individual hydraulic cylinders may be fed from one single source of pressurized fluid or, alternatively, from several pumps having adapted outputs. Feeding is controlled by means of control valves which, in most simple designs may be manually actuated or a series of sequence controllers of a type typically known in the art may be used. In order to reduce the pump capacity required, at least cylinders 34 and 56 may be operated sequentially instead of simultaneously and preferably, only one cylinder is operated at a time.

Figure 2:
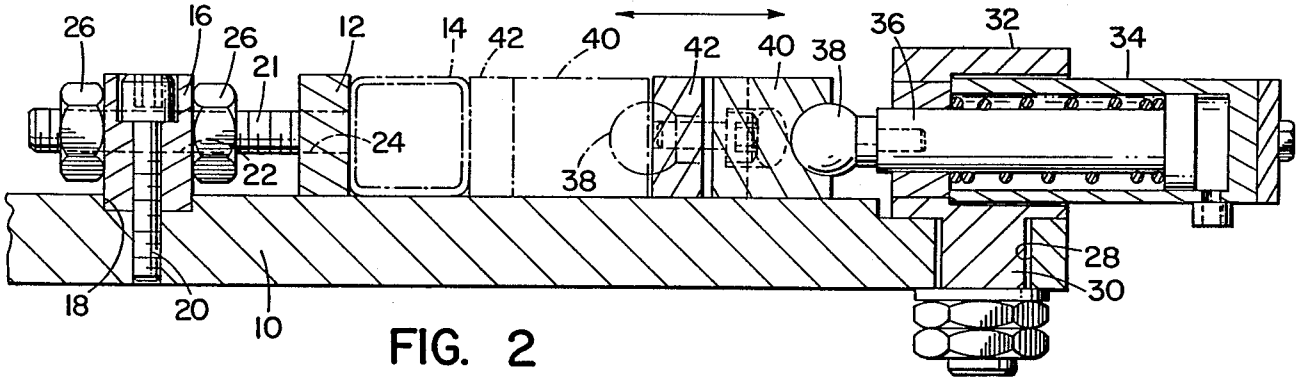
FIG. 2 is a partial sectional view in the plane defined by line A—A in FIG. 1, scale enlarged.
Figure 4:
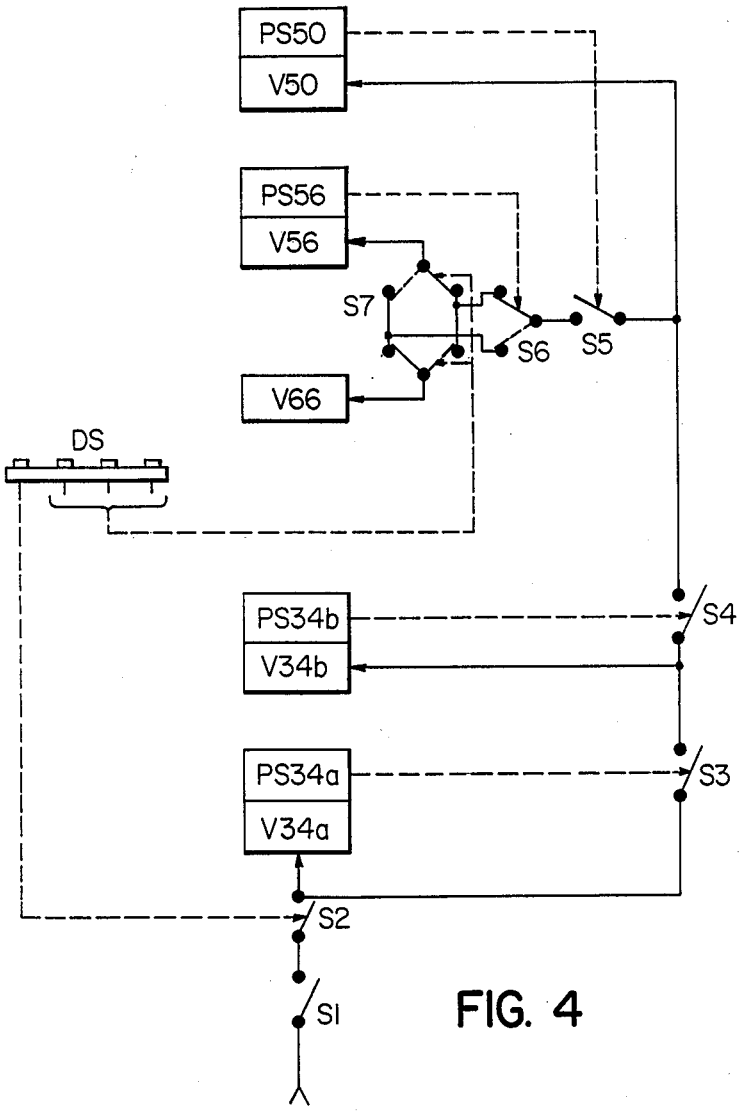
FIG. 4 is a schematic view of the hydraulic cylinder control system.

FIG. 4 illustrates a schematic of a simplified embodiment of an electro-hydraulic control system for the machine as shown on FIGS. 1–3. The individual hydraulic cylinders, shown typically at 34, 50, 56 and 66 respectively, are to be actuated by the operation of fluid pressure. When each cylinder is rendered inoperative, the pressurized hydraulic fluid has been drained from the same and the piston is returned to its cylinder bore by the pair of associated springs, shown typically at 44 on FIG. 1.

The fluid pressure to each cylinder is controlled by a solenoid valve, represented in FIG. 4 as V34A, V34B, V50, V56 and V66, and each is operatively connected to cylinders 34, 50, 56 and 66 respectively. Cylinders 34, 50 and 56 are individually associated with pressure sensors shown as PS34A, PS34B, PS50 and PS56, respectively. It is recognized that the pressure in each cylinder increases when the member driven by the cylinder is not free to move but instead exerts an opposing force. Each pressure sensor is therefore adapted to produce an output signal when the pressure in the associated cylinder exceeds a predetermined limit. The control signals are electrical in nature and thereby function to operate associated switches S2, S3, S4, S5, S6 and S7 respectively. The respective control lines connecting each switch and sensor are shown as dashed lines on FIG. 4. The switches are arranged such that they act to connect or disconnect the power supply to the individual solenoid valves. Cylinder 66 does not have a pressure sensor. Rather, a displacement indicator, respresented as DS on FIG. 4, senses the pivot angle increments of the lever arms 60 and 62 and produces an output signal upon each successive predetermined angular displacement of the same. Switches S6 and S7 are arranged such that upon each output signal of DS, switch S7 is caused to commutate and upon each output signal of PS56, switch S6 is caused to commutate. Each individual commutation results in a directional change in the flow of electric current such that either V56 or V66 is driven and the other is rendered inoperative. Therefore, through the alternating commutation of switches S6 and S7, controlled by the output signals of displacement sensor DS and pressure sensor PS56, lever arms 60 and 62 are incrementally driven by cylinder V66, wherein hydraulic cylinder 56 performs a bending stroke and subsequent withdrawal at each successive increment.

In operation, the closing of switches S1 and S2 permits the flow of electric current to solenoid valve V34A. The actuation of solenoid valve V34A functions to permit the flow of pressurized hydraulic fluid to the cylinder 34 located along the line of symmetry of the apparatus. Thereafter the center portion of tube 14 is placed in pressurized engagement with shape member 12. Termination of the stroke is indicated by pressure sensor PS34A which operates to close switch S3 while leaving solenoid valve V34A actuated and therefore cylinder 34 under pressure. Switch S3 permits the flow of current to solenoid valve V34B which operates to actuate the hydraulic cylinder, again shown typically at 34, however arranged in a lateral position with respect to the line of symmetry of the apparatus. The actuation of this first laterally located cylinder operates to form the desired relatively large radii of curvature in tube 14 by driving the center portions of the same into pressurized engagement with shape member 12. Upon completion of the bending stroke of the first lateral cylinder 34 pressure sensor PS34B sends an output signal to switch S4 operating to close the same. Switch S4 permits the flow of electric current to solenoid valve V50 while simultaneously allowing solenoid valve V34B to remain in operation and therefore first lateral cylinder 34 under pressure.

It is recognized that depending upon the length of tube 14 there may be required additional lateral hydraulic cylinders, as shown typically at 34, to provide for a continuous abuttment of tube 14 against shape member 12. Where additional lateral cylinders are required there will be additional corresponding solenoid valves, pressure sensors, and switches to be integrated within the control system in series with switches S3 and S4 and their associated solenoid valve and pressure sensors V34A, PS34A and V34B, PS34B respectively.

Actuation of solenoid valve V50 in turn operates cylinder 50 which drives hold-down plate 46 into pressurized engagement with shape member 12 and socket members 16. Pressure sensor PS50 indicates the termination of the stroke, and as with each cylinder shown typically at 34, cylinder 50 remains under fluid pressure. The output control signal of PS50 operates to close switch S5, and thereby permits the flow of current through the proper orientation of switches S6 and S7, as shown in FIG. 4, to actuate solenoid valve V56. Cylinder 56 is in turn actuated and initiates a bending stroke. Termination of the stroke is signaled by PS56 whose output acts to commutate switch S6, its new position shown as dashed lines on FIG. 4, such that the current path to valve V56 is opened and cylinder 56 is rendered inoperative and withdrawn from tube 14. Thereafter, switch S6 permits the flow of current through the other circuit of S7 to solenoid valve V66. Cylinder 66 may then initiate its first angular displacement of the lever arms 60 and 62 until displacement sensor DS produces its first output signal, which acts to commutate switch S7, its new position shown as dashed lines on FIG. 4, and thereby re-establish a driving circuit for valve V56 and render valve V66 inoperative. As represented in FIG. 4, switch S7 may be of a double-pole double-throw type, and is disposed such that either pole is arranged in electrical communication with switch S6, irrespective of the orientation of the same.

The cycle, comprising the alternating commutation of switches S6 and S7 is repeated with each predetermined angular displacement of cylinder 56. After the last bending stroke of cylinder 56, there is provided space for additional angular movement of lever arms 60 and 62 sufficient to produce a final output signal of displacement sensor DS. This signal operates to open switch S2 and thereby de-energize the entire circuit. Thereafter cylinder 66 retracts the lever arms to their initial sweep position, all other cylinders are disengaged and the finished workpiece may be removed. However, if the operator does not then open S1, the output signal from DS will cease, S2 will close again, and the circuit will be reactivated so that the entire operation may be repeated if so desired.

Although for purposes of simplicity the electro-hydraulic control system as shown on FIG. 4 has been set forth above with reference to operation of only one-half of the symmetrical apparatus, it may similarly be viewed as a representation of a control system for the complete device. Where it is desired to have simultaneous operation of each pair of symmetrically disposed hydraulic cylinders, the solenoid valves shown as V34B, V50, V56 and V66 on FIG. 4, are each connected to two symmetrically disposed hydraulic cylinders. Therefore, the actuation of either solenoid valve V34B or V56 results in a single symmetrical bending operation upon tube 14. Operation of solenoid valve V50 causes symmetrically disposed hold-down plates 46 to be simultaneously driven into pressurized engagement with shape member 12 and contiguous sockets 16. Similarly, operation of solenoid valve V66 causes simultaneous operation of symmetrically disposed cylinders 66 and lever arms 60 and 62, respectively. Displacement sensor DS is also operatively connected to symmetrically disposed cylinders 66 and functions so as to only transmit its output signal upon completion of each cylinder's incremental lever arm driving stroke. Similarly, the respective pressure sensors, shown as PS34B, PS50 and PS56, are each operatively connected to two associated hydraulic cylinders and function such that each does not produce an output signal until both associated cylinders complete their strokes.

Figure 5:
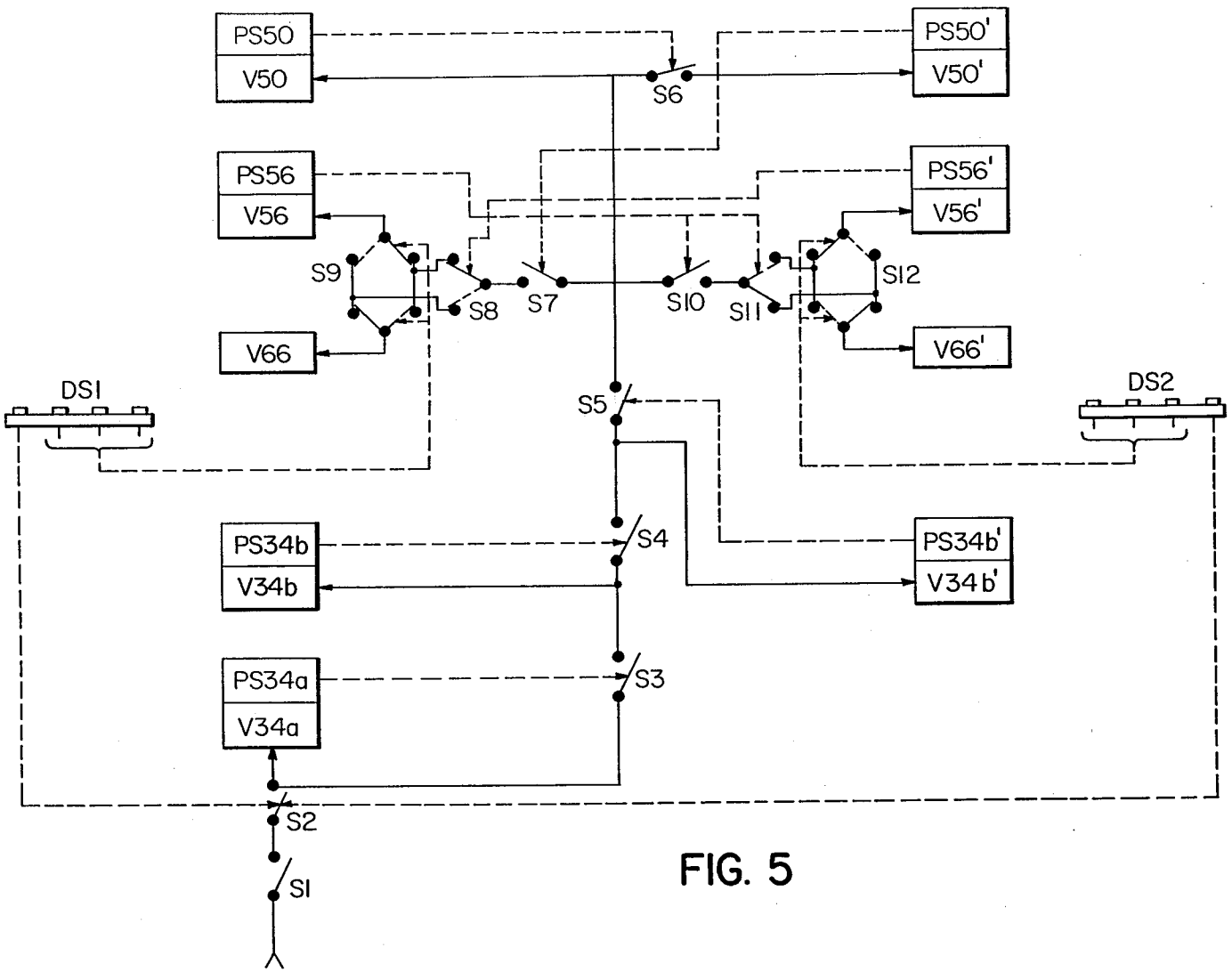
FIG. 5 is a schematic view of another embodiment of the hydraulic cylinder control system.

In a further embodiment of the present invention the symmetrically disposed cylinders are not operated simultaneously but rather in a successive manner. As shown on FIG. 5, each hydraulic cylinder contained within the apparatus is operated by an individual solenoid valve. Furthermore, each hydraulic cylinder, except the pair of cylinders shown typically at 66, is individually associated with its own pressure sensor. As shown in FIG. 5, the individual solenoid valves are operatively connected such that the associated symmetricallly disposed cylinders are operated in a successive manner. Pressure sensor PS34B operates to close switch S4 after the first laterally disposed cylinder 34 completes its bending stroke, thereby causing successive operation of its symmetrically disposed counterpart upon acutation of solenoid valve V34B'. Completion of the bending stroke causes pressure sensor PS34B' to close switch S5 and permit actuation of solenoid valve V50 and subsequent operation of the cylinder driving the first hold-down plate 46. After the same completes its stroke, pressure sensor PS50 operates to close switch S6 which actuates solenoid valve V50' and the cylinder driving the second symmetrically disposed hold-down plate 46. After the same completes its stroke pressure sensor PS50' closes switch S7 which in turn actuates the solenoid valve V56 through the proper orientation of switches S8 and S9, as shown in solid lines in FIG. 5. Solenoid valve V56 permits operation of the first lever arm mounted hydraulic cylinder 56. Upon completion of its bending stroke pressure sensor PS56 produces an output signal which both closes switch S10 and commutates switch S11. The latter's new position is shown in dashed lines in FIG. 5. While first cylinder 56 remains in pressurized engagement with tube 14, solenoid valve V56' operates the second hydraulic cylinder 56. Upon completion of the latter's bending stroke, pressure sensor PS56' produces an output signal which commutates switch S8, its new position shown in dashed lines in FIG. 5. Commutation of switch S8 renders inoperative solenoid valve V56, causing its associated hydraulic cylinder 56 to retract from tube 14, and actuates solenoid valve V66. The first hydraulic cylinder 66 drives its associated lever arms 60 and 62 until displacement sensor DS1 senses the first angular increment of the same, and produces an output signal causing commutation of switch S9, its new position shown in dashed lines in FIG. 5. The first commutation of switch S9 renders solenoid valve V66 inoperative and actuates solenoid valve V56, permitting the first hydraulic cylinder 56 to perform a bending operation upon tube 14 at the new angular location. Upon completion of the latter's bending stroke pressure sensor PS56 produces an output signal causing switch S11 to commutate, its new position shown as a solid line in FIG. 5. Commutation of switch S11 renders solenoid valve V56' inoperative, permitting retraction of second hydraulic cylinder 56, and actuates solenoid valve V66'. The latter permits operation of the second hydraulic cylinder 66 to drive its associated lever arms 60 and 62, until displacement sensor DS2 senses the first angular increment of the same, and produces an output signal causing the first commutation of switch S12, its new position shown in dashed lines in FIG. 5. Commutation of switch S12, renders solenoid valve V66' inoperative and actuates solenoid valve V56', permitting second hydraulic cylinder 56 to perform a bending stroke at the new angular location. Upon completion of the bending stroke pressure sensor PS56' produces an output signal causing switch S8 to commutate and thereby permits another successive angular displacement and bending stroke of first hydraulic cylinder 56, as set forth above.

The alternating operation of first and second hydraulic cylinders 56 continues until both cylinders and their associated lever arms complete their angular sweep around the respective ends of tube 14. Since the first hydraulic cylinder 56 performed the initial bending stroke it will be the first to complete its angular sweep. Its associated displacement sensor DS1 will then send a final output signal to switch S2. However, switch S2 will not open until it receives the final output signal of displacement sensor DS2, when second hydraulic cylinder 56 completes its angular sweep. Upon receipt of final output signals from both DS1 and DS2, switch S2 will open and the entire circuit will be de-energized. Thereafter, first and second hydraulic cylinders 66 retract their associated lever arms to their initial sweep positions, all other cylinders are disengaged and tube 14 may be removed. However, if the operator does not then open switch S1 the output signals from DS1 and DS2 will cease, S2 will close, and the circuit will be reactivated so that the entire operation may be repeated if so desired.

Figure 6:
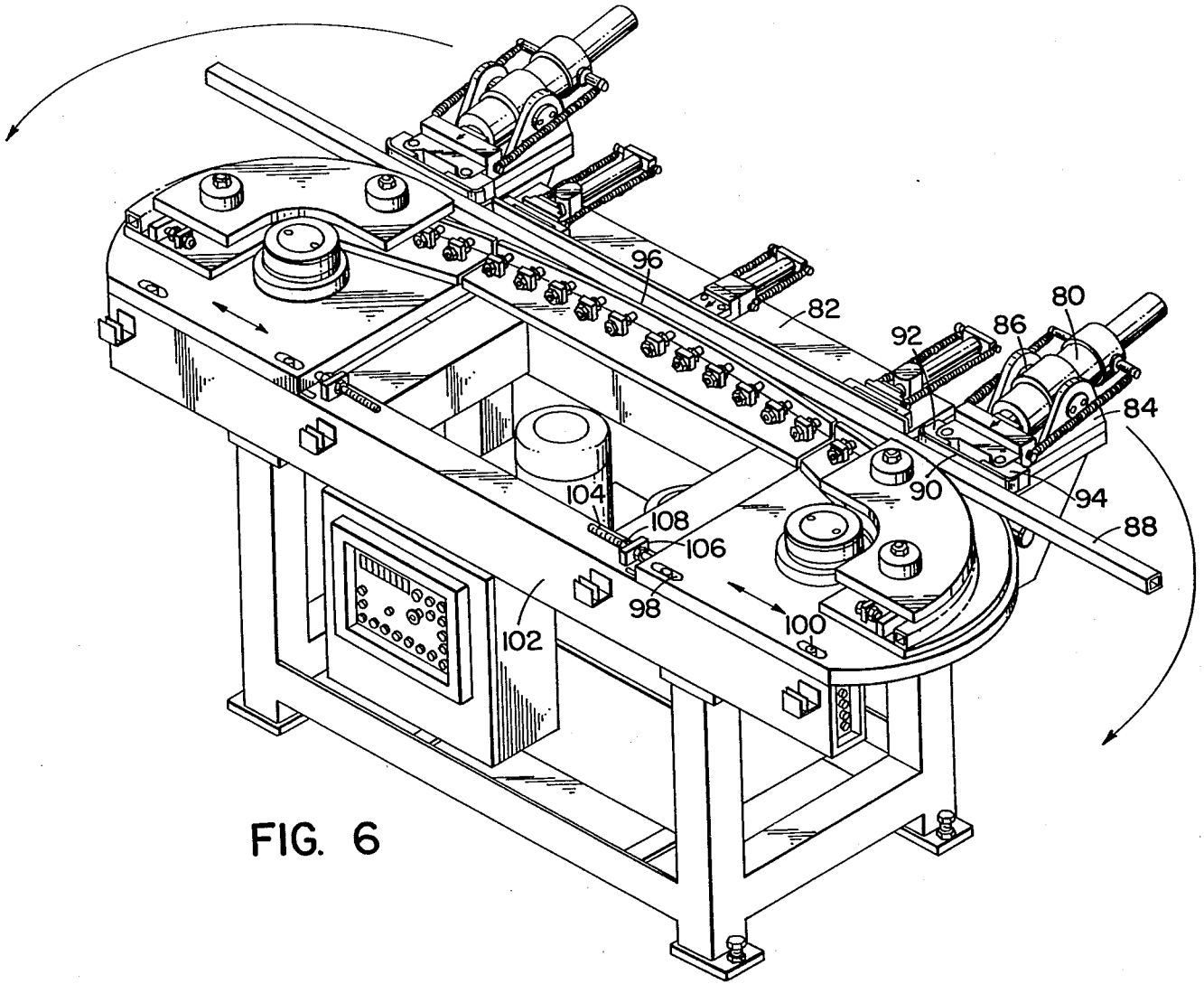
FIG. 6 is a perspective view of the apparatus in accordance with a further embodiment of the present invention.

In a further embodiment of the present invention, as shown in FIG. 6, the apparatus may comprise a modified lever arm mounting system for the outermost pair of symmetrically disposed hydraulic cylinders. As can be seen, this is the only essential difference between this embodiment and those previously described, and therefore will be the only aspect of the present embodiment to be set forth in detail.

The outermost hydraulic cylinders shown typically at 80, are mounted in a plane inclined with respect to that of base plate 82. The lever system, comprising a mounting base 84 and cylinder pivot pins 86, is incrementally driven and controlled in a manner obvious to one skilled in the art in view of previous embodiments set forth in detail above. Pivot pins 86 operate to rigidly mount cylinder 80 to the side walls of mounting base 84. Cylinder pins 86 may be threadedly engaged to cylinder 80 or fixedly attached in a suitably known fashion. The desired inclination angle of cylinder 80 with respect to base plate 82 may be controlled by accordingly locating the level of pivot pins 86 with respect to base plate 82. It is recognized that it may be desireable to drive cylinder 80 in an inclined manner depending upon the configuration and mechanical properties of tube 88, as in certain situations it may operate to constrain vertical buckling of the same. Furthermore it may be desireable to fixedly attach a flexible support strip, shown typically at 90, to the pivotably mounted cylinder shoes 92 and 94 to distribute the forces exerted by the same against tube 88.

A further advantage of the present embodiment is that base plate 82 and shape member 96 each comprise individual sections such that each of the same may be laterally adjusted to conform to varying lengths and desired configurations of tube 88. Each of the symmetrically disposed end sections of base plate 82 comprise a series of slots, shown typically at 98, to permit lateral adjustment of the same. A series of guide pins, shown typically at 100, are rigidly mounted within frame 102 and individually associated with each slot 98 to permit only lateral adjustment of the associated section of base plate 82. A threaded adjustment rod, shown typically at 104, is fixedly attached to a cooperating end section of base plate 82 and slideably mounted through an associated mounting member, shown typically at 106. Each mounting member 106 is rigidly attached to frame 102. A pair of adjustment nuts, shown typically at 108, are threadedly engaged to rod 104, and are each arranged in pressurized enagement with opposing surfaces of mounting member 106. Through cooperative rotation of nuts 108, rod 104 may be translated against stationary mount 106 to permit lateral adjustment of the associated end section of plate 82. As can be seen on FIG. 6, the limitations on the degree of lateral adjustment permitted will essentially be controlled by the longitudinal dimensions of each slot 98. When the end section of plate 82 is adjusted to its desired position, each pair of adjustment nuts 108 are then rotated into pressurized engagement with the associated mounting member 106, functioning to lock the end section of plate 82 into place.

Several modifications of the embodiments set forth above may be made in order to increase applicability or facilitate handling.

For example, the base plate 10 may be split in its plane of symmetry resulting in two mirror-symmetrical halves which may be approached or withdrawn from each other, permitting adaptation of the installation to tube lengths of different dimensions. Of course, the central gap is to be closed by an insert plate, and the template means also must be supplemented by a central piece (or the entire template is replaced). Furthermore, hold-down plate 46 may be arranged such that when vertically lifted it may be simultaneously or subsequently moved away from the tube in the horizontal direction so as to facilitate removal of the same.

Still further, shoes 40 need not necessarily be positively connected to tape 42. Instead, there may be arranged a slideable interface permitting relative movement of the shoes and the tape in the direction of the tube length. This design allows a lateral adjustment of the shoes during preparation of the apparatus, which may be desireable or even necessary in certain cases. This is particularly true if a split base plate is used as mentioned above.

Finally, the lever system comprising arms 60 and 62 may be replaced by one single lever arm mounted beneath the base plate and arranged in a manner similar to that of arm 62. While this approach may provide the advantage of allowing the bent tube to be more easily removed from the apparatus, the relatively high torque acting upon the bearing of lever 62 must be compensated by appropriate means, otherwise hydraulic cylinder 56 would become subject to premature wear and tear due to alternating deformations. Instead of actuating cylinder 66 which is pivotably coupled to the lever system, coupling means in the form of a toothed rack cooperating with a toothed pinion gear may be used, the rack being hydraulically driven. The one hydraulic cylinder 56 may be replaced by a pair of cylinders, wherein their individual shoes may be interconnected by an elastic tape similar to tape 42.

I claim:

1. An apparatus for bending a tubular workpiece to assume a shape including two substantially parallel end portions joined by a central portion of predetermined curvature, said apparatus comprising:

base plate means having a substantially horizontal upper surface, template means including contour adjustment means mounted on said base plate surface and having a contour commensurate with said shape, said template means comprising a tape-like elastically deformable shaped member and adjustment elements rigidly supported by said base plate by means of socket members, and said template contour being adjustable within limits determined by quality variations of said workpiece, generally horizontally displaceable shoe means adapted to deflect a straight tube length placed in front of said template means into engagement with the latter, adjacent shoe means being connected by an elastic tape extended substantially parallel to said tube length, hydraulic cylinder means respectively drivingly connected to said shoe means, control means selectively connecting said hydraulic cylinder means to a source of hydraulic pressurized fluid, said displaceable shoe means comprising a first set of shoes driven by hydraulic cylinders stationarily mounted on said base plate means and adapted to bend said tube length to assume said central portion shape, and at least one second set of movable shoes, consisting of two shoes adapted to provide bending of said tube end portions, each shoe of said second set being mounted, together with its hydraulic cylinder means, on a lever means pivotable in a plane parallel to said upper horizontal surface for shoe and cylinder movement along an adjacent tube end portion, said control means being enabled and disabled in sequence such that first, said first set of shoes are operated by associated hydraulic cylinders to clamp said tube to said template means at its said central portion of the tube length, thereafter, while maintaining engagement of said shoes of said first set with said tube so that the latter is firmly clamped to said template means, said lever means is pivoted incrementally about predetermined angles and in each position so achieved, the hydraulic cylinder means of the shoes of said second set are actuated so as to incrementally bend said end portions of said tube length progressively from inner to outer ends of said end portions.

2. An apparatus as set forth in claim 1 wherein a plurality of hydraulic cylinder means are sequentially supplied with pressurized fluid from said source.

3. An apparatus for bending a tubular workpiece to assume a shape including two substantially parallel end portions joined by a central portion of predetermined curvature, said apparatus comprising:

base plate means having a substantially horizontal upper surface, template means mounted on said base plate surface and having a contour commensurate with said shape, said template contour being adjustable within limits determined by quality variations of said workpiece, generally horizontally displaceable shoe means adapted to deflect a straight tube length placed in front of said template means into engagement with the latter, hydraulic cylinder means drivingly connected to said shoe means, said displaceable shoe means comprising a first set of shoes driven by hydraulic cylinders stationarily mounted on said base plate means and adapted to bend said tube length to assume said central portion shape, and at least one second set of movable shoes, consisting of two shoes adapted to provide bending of said tube end portions, each shoe of said second set being mounted, together, with its hydraulic cylinder means, on a lever means drivingly connected to its associated hydraulic cylinder means and pivotable in a plane parallel to said upper horizontal surface for shoe and cylinder movement along an adjacent tube end portion, and hold-down means restraining said length of tube against vertical motion with respect to said base plate upper surface during operating periods of said hydraulic cylinder means control means selectively connecting said hydraulic cylinder means to a source of hydraulic pressurized fluid, said control means comprising solenoid valving means associated with each of said hydraulic cylinder means and functioning to permit the flow of pressurized hydraulic fluid to the same;

pressure sensor means assoicated with each of said hydraulic cylinder means drivingly connected to said shoe means and with each of said hold-down means, and functioning to provide an output signal dependent upon the pressure exerted by said associated hydrualic cylinder means and said hold-down means;

displacement sensor means associated with each of said cylinder means drivingly connected to said lever means, and functioning to provide an output signal dependent upon the angular displacement of each of said lever means;

electric circuit means functioning to place said solenoid valving means, said pressure sensing means, and said displacement sensor means in electrical communication, said control means being enabled and disabled in sequence to feed pressurized fluid alternatingly to said hydraulic cylinder means and to said hold down means such that first, said first set of shoes are operated by associated hydraulic cylinders to clamp said tube to said template means at its said central portion of the tube length, thereafter, while maintaining engagement of said shoes of said first set with said tube so that the latter is firmly clamped to said template means, said levers are pivoted incrementally about predetermined angles and in each position so achieved, the hydraulic cylinder means of the shoes of said second set are actuated so as to incrementally bend said end portions of said tube length progressively from inner to outer ends of said end portions.

4. An apparatus as set forth in claim 3 wherein at least one of said hold-down means is hydraulically operable.

5. An apparatus as in claim 3 wherein said electric circuit means comprises at least one switching means assoicated with each of said solenoid valving means, said pressure sensor means, and said displacement sensor means, and functioning to selectively permit electric current flow to each of the same.

6. An apparatus as in claim 3 wherein said control means comprises:

a first and second of said switching means disposed in series functioning to permit electric current flow to a first solenoid valving means associated with a first hydraulic cylinder means mounted substantially along the line of symmetry of said apparatus, said first solenoid valving means operates to permit the flow of pressurized hydraulic fluid to said first hydraulic cylinder means, causing the same to drive said tube into pressurized engagement with said template means, a first pressure sensor means associated with said first hydraulic cylinder means provides an electric output signal to a third switching means when said first hydraulic cylinder means completes its bending stroke, said third switching means permits electric current flow to a second solenoid valving means associated with a pair of symmetrically disposed second hydraulic cylinder means laterally mounted with respect to said first hydraulic cylinder means, said second solenoid valving means operates to permit the flow of pressurized hydraulic fluid to said second hydraulic cylinder means, a second pressure sensor means provides an electric output signal to a forth switching means upon the completion of the bending stroke of said second hydraulic cylinder means, said fourth switching means permits the flow of electric current to a third solenoid valving means associated with a pair of symmetrically disposed hold-down means, said third solenoid valving means operates to permit the flow of pressurized hydraulic fluid to said hold-down means causing the same to be arranged in pressurized engagement with said template means and in overlying relation with said tube to constrain vertical movement of the same, a third pressure sensor means provides an electric output signal to a fifth switching means upon the completion of the clamping stroke of said hold-down means, said fifth switching means is disposed in series with a sixth and seventh switching means and the operation of said switching means permits the flow of electric current to a fourth solenoid valving means associated with a pair of symmetrically disposed third hydraulic cylinder means, wherein each is rigidly mounted to one of said lever means, and operation of said fourth solenoid valving means permits the flow of pressurized hydraulic fluid to said third hydraulic cylinder means, a fourth pressure sensing means provides an electric output signal to said sixth switching means upon the completion of the bending stroke of said third hydraulic cylinder means, said output signal causes said sixth switching means to commutate such that it directs the flow of current to a fifth solenoid valving means and simultaneously interrupts the flow of electric current to said fourth solenoid valving means rendering said third hydraulic cylinder means inoperative, thereby allowing the same to withdraw from pressurized engagement with said tube, said fifth solenoid valving means is associated with a pair of symmetrically disposed fourth hydraulic cylinder means, each drivingly connected to one of said lever means, wherein operation of said fifth solenoid valving means permits the flow of pressurized hydraulic fluid to said fourth hydraulic cylinder means to cause angular displacement of said lever means, a displacement sensor means associated with said fourth hydraulic cylinder means provides an electric output signal to said seventh switching means at predetermined intervals of angular displacement of said lever means, said output signal operates to commutate said seventh switching means such that it interrupts the flow of electric current to said fifth solenoid valving means rendering said associated fourth hydraulic cylinder means inoperative, and causing said lever means to remain at said predetermined angular location, and simultaneously directs the flow of electric current to said fourth solenoid valving means to operate said third hydraulic cylinder means to drive said tube against said template means at said successive angular position of each of said lever means, upon completion of the bending stroke of said third hydraulic cylinder means said output signal of said fourth pressure sensing means operates to commutate said sixth switching means to again reverse the direction of electric current flow to said fifth solenoid valving means, thereby operating to retract said third hydraulic cylinder means and actuate said fourth hydraulic cylinder means, causing successive angular displacement of said lever means, said incremental angular displacements and cooperating bending operations controlled through the alternating commutation of said sixth and said seventh switching means continues until said displacement sensor means identifies the last predetermined increment of angular displacement of said lever means, wherein said displacement sensor means sends an output signal to said second switching means causing the same to open and thereby interrupt the flow of electric current to said electric circuit means rendering inoperative each of said solenoid valving means, said pressure sensor means, and said displacement sensor means, and thereby cause each of said hydraulic cylinder means and hold-down means to return to their initial inoperative positions for removal of said tube.

7. An apparatus as in claim 3 wherein said control means causes said symmetrically disposed hydraulic cylinders to operate in an alternating manner and comprises:

a first and second of said switching means disposed in series functioning to permit electric current flow to a first solenoid valving means associated with a first hydraulic cylinder means mounted substantially along the line of symmetry of said apparatus, actuation of said first solenoid valving means operates to permit the flow of pressurized hydraulic fluid to said first hydraulic cylinder means, causing the same to drive said tube into pressurized engagement with said template means, a first pressure sensor means associated with said first hydraulic cylinder means provides an electric output signal actuating a third switching means when said first hydraulic cylinder means completes its bending stroke, said third switching means functions to permit the flow of electric current to a second solenoid valving means associated with a second hydraulic cylinder means laterally mounted with respect to said first hydraulic cylinder means, said second solenoid valving means operates to permit the flow of pressurized hydraulic fluid to said second hydraulic cylinder means, a second pressure sensor means provides an electric output signal actuating a fourth switching means upon the completion of the bending stroke of said second hydraulic cylinder means, said fourth switching means functions to permit the flow of electric current to a third solenoid valving means associated with a third hydraulic cylinder means symmetrically disposed with respect to said second hydraulic cylinder means, a third pressure sensor means provides an electric output signal actuating a fifth switching means upon completion of the bending stroke of said third hydraulic cylinder means, said fifth switching means functions to permit the flow of electric current to a fourth solenoid valving means associated with a first hold-down means, said fourth solenoid valving means operates to permit the flow of pressurized hydraulic fluid to said first hold-down means causing the same to be driven into pressurized enagement with said template means and in overlying relation with said tube, a fourth pressure sensor means provides an electric output signal actuating a sixth switching means upon the completion of the stroke of said first hold-down means, said sixth switching means functions to permit the flow of electric current to a fifth solenoid valving means associated with a second hold-down means symmetrically disposed with respect to said first hold-down means, said fifth solenoid valving means operates to permit the flow of pressurized hydraulic fluid to said second hold-down means, causing the same to be arranged in overlying relation with a portion of said tube symmetrically disposed with respect to that underlying said first hold-down means, a fifth pressure sensor means provides an electric output signal actuating a seventh switching means upon the completion of the stroke of said second hold-down means, said seventh switching means is disposed in series with an eighth and ninth switching means and the operation of said switching means permits the flow of electric current to a sixth solenoid valving means associated with a fourth hydraulic cylinder means rigidly mounted upon a first lever means, said sixth solenoid valving means permits the flow of pressurized hydraulic fluid to said fourth hydraulic cylinder means, upon completion of the bending stroke of said fourth hydraulic cylinder means a sixth pressure sensor means provides an electric output signal operating to actuate a tenth switching means and commutate an eleventh switching means, said tenth and eleventh switching means are disposed in series with a twelfth switch means, and the operation of said switching means permits the flow of electric current to a seventh solenoid valving means associated with a fifth hydraulic cylinder means rigidly mounted upon a second lever means symmetrically disposed with respect to said first lever means, said seventh solenoid valving means permits the flow of pressurized hydraulic fluid to said fifth hydraulic cylinder means, upon completion of the bending stroke of said fifth hydraulic cylinder means a seventh pressure sensor means provides an electric output signal operating to commutate said eighth switching means so as to redirect electric current flow from said sixth solenoid valving means to an eighth solenoid valving means, said fourth hydraulic cylinder means mounted upon said first lever means is thereby rendered inoperative and released from pressurized engagement with said tube, said eighth solenoid valving means is associated with a sixth hydraulic cylinder means drivingly connected to said first lever means and operates to permit the flow of pressurized hydraulic fluid to said sixth hydraulic cylinder means causing the same to translate said first lever means, a first displacement sensor means provides an electric output signal to said ninth switching means at predetermined intervals of angular displacement of said first lever means, upon completion of said first angular displacement of said first lever means said first displacement sensor means provides an output signal operating to commutate said ninth switching means, said commutation renders inoperative said eighth solenoid valving means causing said first lever means to remain idle at said first incremental position, electric current flow is thereby redirected to said sixth solenoid valving means, actuating the same and operating to cause said fourth hydraulic cylinder mean to perform a bending operation at said first incremental position, upon completion of the bending stroke of said fourth hydraulic cylinder means said sixth pressure sensor means provides an electric output signal causing commutation of said eleventh switching means, said eleventh switching means then redirects electric current flow from said seventh solenoid valving means to a ninth solenoid valving means associated with a seventh hydraulic cylinder means drivingly connected to a second lever means symmetrically disposed with respect to said first lever means, said seventh solenoid valving means is thereby rendered inoperative causing said fifth hydraulic cylinder means mounted upon said second lever means to retract from said tube, said ninth solenoid valving means permits the flow of pressurized hydraulic fluid to said seventh hydraulic cylinder means permitting the same to translate said second lever means, a second displacement sensor means provides an electric output signal to said twelfth switching means causing commutation of the same at predetermined intervals of angular displacement of said second lever means, upon completion of the first angular displacement of said second lever means said output signal of said second displacement sensor means commutates said twelfth switching means so as to redirect electric current flow to said seventh solenoid valving means and render inoperative said ninth solenoid valving means causing said seventh hydraulic cylinder means and second lever means to remain idle at said first incremental position, said seventh solenoid valving means permits the flow of pressurized hydraulic fluid to said fifth hydraulic cylinder means permitting the same to perform a bending operation at said first incremental position, upon completion of the bending stroke said seventh pressure sensor means provides an output signal causing commutation of said eighth switching means and subsequent retraction of said fourth hydraulic cylinder means and actuation of said eighth solenoid valving means to cause a successive incremental displacement of said first lever means, said alternating incremental angular displacements and cooperating bending strokes of said first lever means and said fourth hydraulic cylinder means, and said second lever means and said fifth hydraulic cylinder means, continues until said first displacement sensor means and said second displacement sensor means each identify the last predetermined increment of angular displacement of said associated lever means, wherein each respective displacement sensor means produces a final electric output signal causing said second switching means to open upon receipt of both of said signals, and thereby interrupts the flow of electric current to said circuit means, rendering inoperative each of said solenoid valving means, said pressure sensor means, and said displacement sensor means, to cause each of said hydraulic cylinder means and hold-down means to return to their initial inoperative positions for removal of said tube.

8. An apparatus as in claim 3 wherein:

said hydraulic cylinder means drivingly connected to said second set of said displaceable shoe means is mounted in a plane inclined with respect to that of said base plate means, said base plate means comprises a middle section and two symmetrically disposed end sections arranged in a manner such that said end sections may be laterally adjusted to conform to varying lengths and configurations of said tube, said template means comprises separable sections corresponding with said sections of said base plate means, said second set of movable shoes have fixedly attached thereto a flexible strip extending substantially parallel to said tube length.

* * * * *